United States Patent [19]

Althouse, III

[11] 4,453,829

[45] Jun. 12, 1984

[54] APPARATUS FOR MIXING SOLIDS AND FLUIDS

[75] Inventor: James W. Althouse, III, Tulsa, Okla.

[73] Assignee: The Dow Chemical Company, Midland, Mich.

[21] Appl. No.: 426,320

[22] Filed: Sep. 29, 1982

[51] Int. Cl.[3] ..... B01F 7/16; B28C 5/00

[52] U.S. Cl. ..... 366/13; 366/40; 366/65; 366/262; 366/343

[58] Field of Search ..... 366/2, 6, 17, 33–35, 366/38, 65, 159, 169, 142, 172, 178, 180, 177, 343, 168, 183, 262–265, 279, 270, 292, 293, 342, 343, 10, 13, 40

[56] References Cited

U.S. PATENT DOCUMENTS 3,147,957 9/1964 Martin ..... 366/263

3,326,536 6/1967 Zingg et al. ..... 366/17

*Primary Examiner*—Timothy F. Simone

*Attorney, Agent, or Firm*—V. Dean Clausen

[57] ABSTRACT

Disclosed herein is an apparatus useful for blending solids with fluids. In a specific application of the blender, sand is mixed with a gel composition to obtain a fluid mixture suitable for stimulation treatments of oil and gas wells. Basic components of this blender are a slinger member and an impeller member, which are enclosed within a casing. The slinger and impeller are fastened together, with the impeller being positioned underneath the slinger. In addition, the slinger has a toroidal configuration and the impeller has a vortex configuration, and the slinger has a larger surface area than the impeller. The toroidal shape of the slinger, and its larger size, contribute to a good pressure balance within the fluid composition as it circulates inside the casing during the mixing operation. A more thorough mixing of the sand and gel composition is achieved by improving the pressure balance in the manner described.

4 Claims, 2 Drawing Figures

APPARATUS FOR MIXING SOLIDS AND FLUIDS

BACKGROUND OF THE INVENTION

Broadly, the invention relates to an improved apparatus for continuously mixing solid particles with a fluid composition. In a specific application, this apparatus is employed as a blender, in which sand or sand-like particles are mixed (or blended) with a gel composition, and the resulting slurry is pressurized by the mixer itself. A typical use for the resulting slurry is as a treating fluid, which is introduced into a well to enhance recovery of a petroleum product.

The sand blender described in U.S. Pat. No. 3,326,536 (Zingg et al.) is typical of conventional "closed-system" blenders now being used in oil or gas recovery operations. This patent describes two different embodiments of the blender, as illustrated in FIGS. 1 and 4. Both of these designs have certain drawbacks, which point up the need for improvement in blenders and other equipment used in downhole recovery operations.

In a continuous blending operation the objective is to be able to mix a slurry of particulate material (such as sand or other propping agents) and fluid (the gel composition, or other fluid, such as water) and pressurizing the resulting slurry to a desired level. The Zingg et al. machines have certain drawbacks which make it difficult to blend successfully the particulates and the fluid composition. For example, the structure of the mixing impeller creates a significant restriction in the flow of solids into the casing. The large surface area of the impeller and the fact that the impeller has a very close fit within the casing also contributes to frictional drag and erosion of the impeller and other parts of the blender. Also, the fluid composition tends to be trapped inside the rotating impeller, so that the recirculation required for thorough mixing of the solids and fluids is inadequate for many mixtures used in modern well treatments. As the solids to fluid ratio increases, the performance declines rapidly.

All of the embodiments described in the Zingg et al. patent require at least one fluid seal to prevent recirculation loss within the casing, as well as abrasive erosion of the blender parts. The elements of this seal must be held concentric by the impeller shaft, for proper operation and an economical operating life. This requirement dictates precisely constructed apparatus which is difficult to maintain under the harsh conditions of normal operation. As an overall problem, the blender described above can pack-off or jam with solids, which causes overheating and usually requires complete shutdown of the mixing operation.

The blender apparatus of this invention, utilizes a slinger element having a toroidal configuration, which differs in several respects from the blenders described in the Zingg et al. patent. The shape of the slinger element enables it to control the flow of fluid independently of its fit in the case. The blades of the slinger element are preferably laid out on a log spiral curve, so that they remain clear of particles, to prevent the machine from clogging. In operation, the slinger maintains a finite "eye" or opening at ambient pressure, through which solids are introduced.

The present blender also provides a positive gap or space between the blades of the slinger member and the casing. This allows the fluid to interface with the atmosphere at this gap, rather than inside the impeller, as in the Zingg et al. blenders. The slinger provides a deliberate recirculation of fluid through this gap, and the result is excellent control of the pressure distribution in the casing, as well as thorough mixing of the slurry. In contrast, prior blenders required mechanical seals to prevent recirculation, which reduces their performance and causes unacceptable wear. The combination of a vortex-type impeller and a toroidal slinger allows the blender to exhaust air through the eye. In contrast to earlier blenders, the unit will self-prime from a positive head and will not gas-lock. In the normal use of the blender, this feature is an important advantage. The blender can also mix particulates less dense than the fluid component of the mixture and discharge a well-blended slurry.

SUMMARY OF THE INVENTION

The blender apparatus of this invention is particularly adapted for mixing solid particles, such as sand, with a fluid composition, such as a gel. The solid particles are contained in a hopper having an outlet at the bottom of the hopper. A drive shaft extends into a casing. A slinger member is attached to the drive shaft and an impeller member is fastened to the underside of the slinger member and also to the drive shaft. The casing encloses the slinger and impeller members, which are rotatable within the casing. During a mixing operation, a drive means rotates the drive shaft, to drive the slinger and the impeller. The fluid composition is carried into the casing through an inlet conduit having one end in communication with the casing and the opposite end is connected into the source for the fluid. Following the admixture of the solid particles within the casing, the mixture is discharged through an outlet port in the casing.

DESCRIPTION OF A PREFERRED EMBODIMENT

Figure 1:
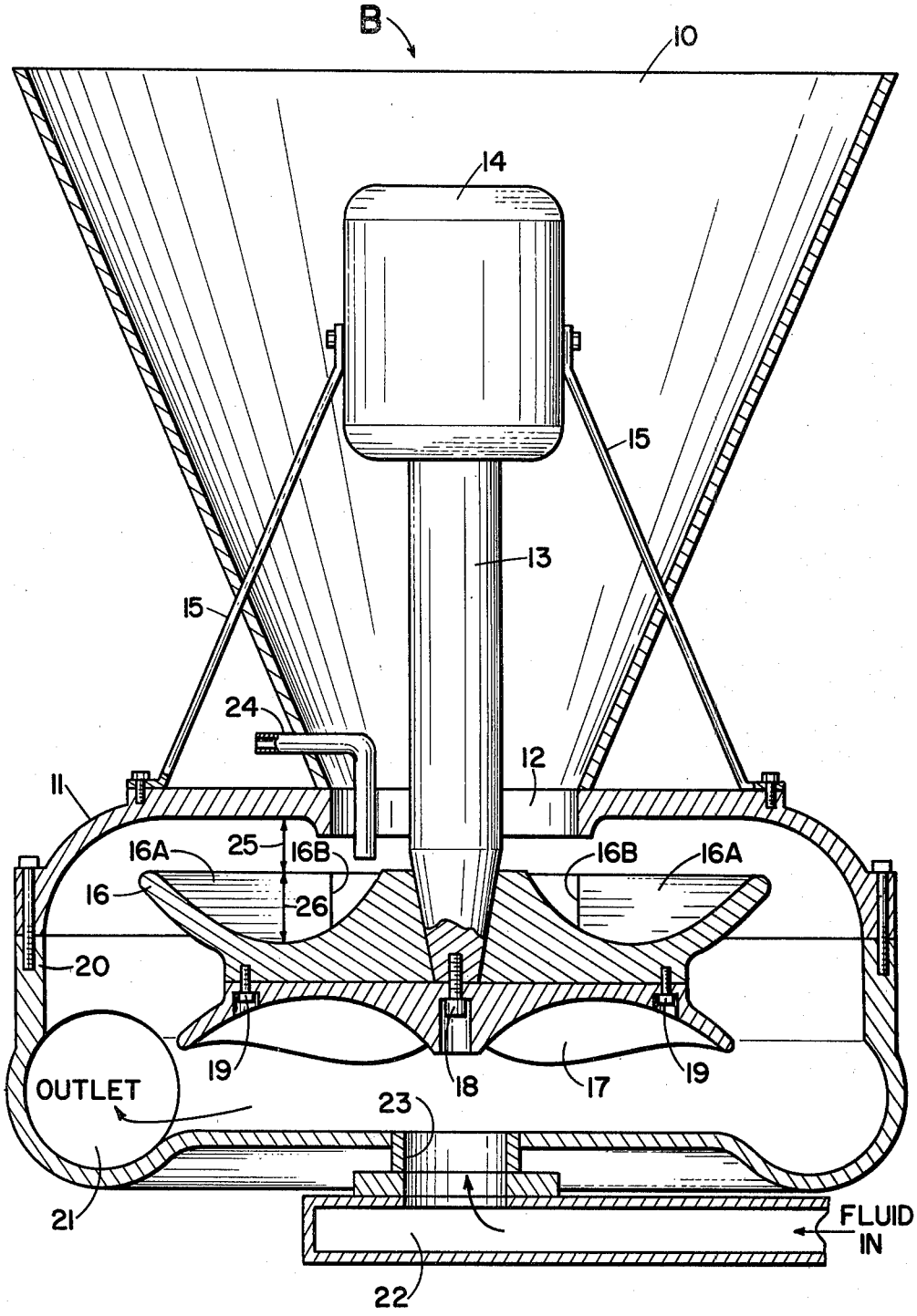
FIG. 1 is a front elevation view, mostly in section, of the blender apparatus of this invention.
Figure 2:
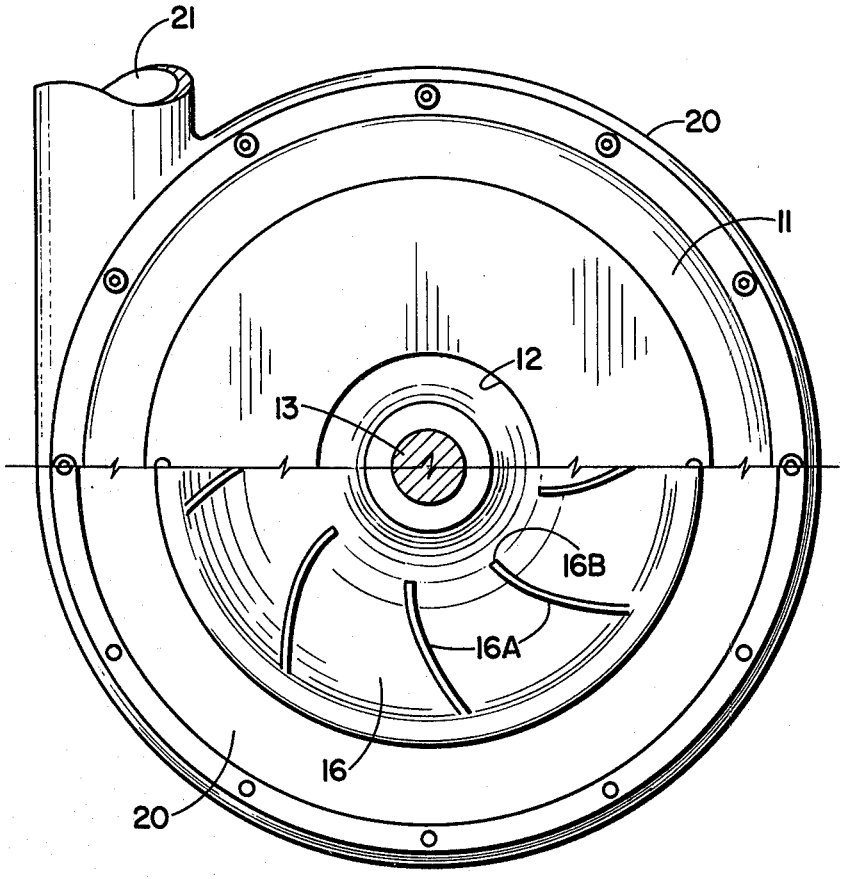
FIG. 2 is a half section view, looking down on the blender from above. The top half of the drawing is an exterior view of the top side of the blender casing, and the bottom half is an exterior view of the slinger element.

Referring to the drawing, particularly FIG. 1, the blender apparatus of this invention is generally indicated by the letter B. At the top of the blender is a hopper 10. The hopper provides a container for solid particles, such as sand (not shown). In this embodiment the hopper 10 is mounted on the top side of the blender casing 11. The hopper fits over an opening 12, which provides an inlet "eye" for dropping the sand or other solid particles into the blender.

A drive shaft 13 is positioned inside the hopper 10, such that the bottom of the shaft extends through the inlet eye 12 and into the casing 11. A motor 14 for driving the shaft is mounted at the top end of the shaft. The motor is connected to the top cover of the casing 11 by support rods 15, to provide a hanger means for the motor and the drive shaft. The mixer elements of the blender apparatus consist of a slinger member 16 and an impeller member 17. The impeller member 17 is secured to the bottom end of the drive shaft 13 by a bolt fastener 18.

The slinger member 16 has a flat face which matches a corresponding flat face on the impeller member 17, and the two members are fastened together at their common faces by bolt fasteners 19. In addition, the slinger member has a central opening therein (not shown) which allows it to fit over the tapered end of the drive shaft above the bolt fastener 18. In the practice of this invention, the slinger 16 has a toroidal configuration, including a concave surface which faces toward the top of the casing 11. The impeller 17 is of a vortex configuration, with a concave surface which faces toward the bottom of the casing. In actual practice, these design features greatly enhance thorough mixing of the solids with the fluid composition. In the specific embodiment illustrated herein, the surface of slinger 16 is interrupted by several upstanding blade members **16*a*. As indicated in FIG. 1, the inside edge 16*b* of each blade is a vertical edge which is aligned approximately with the periphery of the inlet eye 12**.

The bottom part of the blender apparatus is defined by a casing 20, which encloses the slinger 16 and impeller 17. Casing 20 includes an outlet port 21, for the discharge of material from the casing. One end of an inlet conduit 22 is connected into the casing 20 and the opposite end of the conduit is connected into a source for a fluid composition, such as a gel composition. During the mixing operation the fluid composition is drawn into the casing 20 through the inlet conduit 22 and a suction-eye inlet 23 at the bottom of the casing. Means for venting gases from the blender apparatus is provided by a breather tube 24, which is installed in the top casing 11. As shown in FIG. 1, it is preferred that the interior end of breather tube 24 be positioned within the periphery of the inlet eye 12, with the exterior end being positioned such that it communicates with the atmosphere exterior to casing 11.

OPERATION

The invention may be illustrated by describing a typical operation in which sand is mixed with a gel composition to obtain a fluid mixture suitable for injecting into an earth fracture to stimulate recovery of oil or gas. At the start of the mixing operation, the motor 14 rotates the drive shaft 13, slinger 16 and impeller 17. Once the slinger and impeller are in motion, a desired charge of sand is dropped into hopper 10, so that the sand flows in a continuous stream through the inlet eye 12 and drops onto the rotating slinger 16. As the sand drops onto the slinger 16, it is propelled outwardly into the casing 20. With the vortex impeller 17 rotating at the same speed as the slinger, the vortex action of the impeller creates a suction force inside the casing. This suction force draws the composition into the casing through the suction-eye inlet 23.

As the gel is pulled into the casing, it is pressurized by the impeller and interfaces with the sand being flung outwardly from the slinger 16. The effect is a thorough mixing of the sand and gel composition. The sand-gel mixture is then continuously discharged under pressure developed by the mixer through the outlet port 21. From port 21, the mixture is carried into a pumper unit, which pumps it to the wellhead and down the borehole. The pumper unit, the wellhead, and the borehole are not shown in the drawing.

The construction and operation of the blender apparatus of this invention eliminates most of the limitations found in the prior devices. For example, in the present unit, the gap between the casing and the blades of the slinger member as indicated by numeral 25, allows a much higher particulate flow than the clearance between the impeller shrouds in the Zingg et al. blender. Since the slinger and the impeller are connected together, and rotate at the same speed, the size of the slinger must be significantly larger than the size of the impeller to balance the fluid pressure developed by the impeller. In other words, balancing of the fluid pressure amounts to a "holding back" of the fluid pressure, as developed by the impeller, to the extent that the solids can be readily introduced into the pressurized fluid through the inlet eye 12. The combination of the larger gap, for good recirculation of the fluid through the gap, and the larger size of the slinger, for balancing the fluid pressure distribution within the casing, provides a good mixing of the solids with the fluid. Although the slinger blade members **16*a* may extend from the outer circumference of the slinger to near the point of intersection of shaft 13 with the slinger, a preferred feature, which enhances introduction of the solids into the fluid, is the approximate vertical alignment of each of the inside blade edges 16*b* with the periphery of the inlet eye 12**.

The size of the slinger member can be calculated approximately from the following equation:

$$D^2\text{eye} + D^2\text{impeller} < D^2\text{slinger}$$

where $D^2$eye = diameter (squared) of the suction-eye inlet;

$D^2$impeller = diameter (squared) of the impeller;

$D^2$slinger = diameter (squared) of the slinger.

In the practice of this invention, the size of the gap in the casing, as indicated at 25, is calculated as the linear distance from the upper edge of a slinger blade, to the nearest opposite point on the flat surface of the casing. It is preferred that this distance be about the same as the maximum depth of each slinger blade, that is, the distance from the upper edge of each blade to the lowest point of each blade as indicated by numeral 26. The gap distance defined above is, however, not critical. For example, the gap distance could range from a minimum of about one-half the depth of each slinger blade, to a maximum of about twice the depth of each blade.

The invention claimed is:

1. An apparatus for mixing solid particles with a fluid composition, the apparatus comprising:

a hopper for containing the solid particles, the hopper communicates with a casing;

a drive shaft which extends into the casing;

a slinger member which is attached to the drive shaft;

the slinger member has a toroidal configuration, including a concave surface which faces toward the top of the casing;

the slinger member is interrupted by several blade members, the depth of each blade is the linear distance from the upper edge to the lowest point of each blade, the linear distance between the said upper edge of each blade member and the nearest opposite point on the flat surface of the casing defines a positive gap between the slinger member and the casing; and the linear distance of said positive gap is in the range of from about one-half the depth of each blade to about twice the depth of each blade;

an impeller member which is attached to the underside of the slinger member and to the drive shaft;

the impeller member has a vortex configuration, including a concave surface which faces toward the bottom of the casing;

the slinger member has a larger surface area than the impeller member;

the slinger and the impeller members are enclosed by the casing and said members are rotatable within the casing;

a drive means for rotating the drive shaft, the slinger member, and the impeller member;

an inlet conduit having one end in communication with the casing, and an opposite end in communication with a source for the fluid composition; and an outlet port in the casing for discharging a mixture of the solid particles and fluid composition from the casing.

2. The apparatus of claim 1 in which the hopper opens into the casing through an inlet eye, and the drive shaft extends through the inlet eye into the casing.

3. The apparatus of claim 1 in which the drive means is a motor which is coupled to the drive shaft.

4. The apparatus of claim 1 which includes a means for venting gases from the casing, said vent means having one end in communication with the interior of the casing, and an opposite end in communication with the atmosphere.

* * * * *